US011747086B2

(12) United States Patent
Dresh, Sr. et al.

(10) Patent No.: US 11,747,086 B2
(45) Date of Patent: Sep. 5, 2023

(54) STEELMAKING TAPHOLE SLAG RETARDANT DEVICE

(71) Applicant: JDSS Ltd., Portage, MI (US)

(72) Inventors: John W. Dresh, Sr., Bridgman, MI (US); Thomas J. Connors, St. John, IN (US); Michael Dean Cope, Dyer, IN (US); Robert N. Deyoung, Portage, MI (US)

(73) Assignee: JDSS LTD., Portage, MI (US)

( * ) Notice: Subject to any disclaimer, the term of this patent is extended or adjusted under 35 U.S.C. 154(b) by 61 days.

(21) Appl. No.: 17/306,229

(22) Filed: May 3, 2021

(65) Prior Publication Data

US 2022/0349653 A1 Nov. 3, 2022

(51) Int. Cl.
*F27D 3/15* (2006.01)
*C21C 5/46* (2006.01)

(52) U.S. Cl.
CPC ..... *F27D 3/1518* (2013.01); *C21C 5/4653* (2013.01)

(58) Field of Classification Search
CPC .... C21C 5/4653; F27D 3/1518; F27D 3/1536
USPC ..... 266/45, 271, 272, 236; 222/597
See application file for complete search history.

(56) References Cited

U.S. PATENT DOCUMENTS 4,877,221 A * 10/1989 Scriven ..... C21B 7/12 266/271
4,995,594 A 2/1991 Verbik
5,972,281 A * 10/1999 Stilkerieg ..... B22D 41/44 501/129
6,602,069 B2 8/2003 Purchase
8,591,802 B2 * 11/2013 Koffron ..... B22D 43/002 266/227

* cited by examiner

*Primary Examiner* — Jessee R Roe
*Assistant Examiner* — Michael Aboagye
(74) *Attorney, Agent, or Firm* — FLYNN THIEL, P.C.

(57) ABSTRACT

A steel making assembly comprising a metal, refractory lined vessel having a side wall with a taphole therein and a metal plug placed within the taphole. The metal plug comprises a frustoconical body having a side conical wall, a closed small end and an open large end thereof defining an essentially empty interior space. The side conical wall of the frustoconical body of the plug includes at least one diagonal compression slit. The at least one diagonal compression slit extends from the open large end of the frustoconical body and extends toward the closed small end of the frustoconical body. The conical wall has a center axis, with the at least one diagonal compression slit being non-parallel to the center axis.

9 Claims, 8 Drawing Sheets

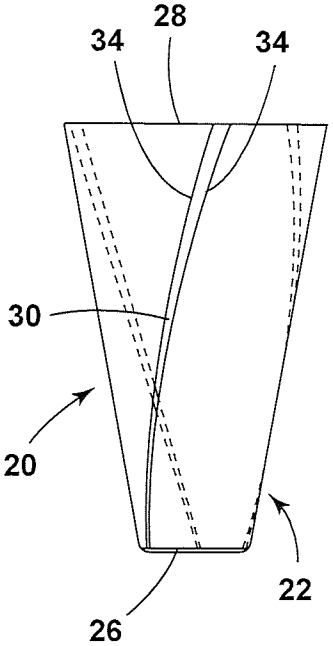
FIG. 8
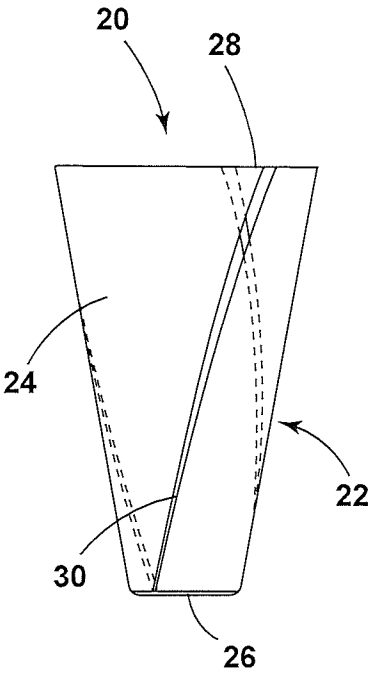
FIG. 9
FIG. 10

STEELMAKING TAPHOLE SLAG RETARDANT DEVICE

FIELD OF THE INVENTION

The present invention relates to steel making, and in particular to a steelmaking taphole slag retardant device.

BACKGROUND OF THE INVENTION

During the production of steel in a converter furnace, impurities, referred to as "slag", float atop the molten metal. It is desirable to remove the molten metal from the furnace separately from as much of the slag as possible to minimize the amount of impurities within the metal. One conventional way of achieving that result is to tilt the furnace while plugging a tap hole of the furnace with a plug so as to block the exit of slag, and then the plug melts after at least most of the slag has passed thereover, whereby molten metal will be poured from the tap hole while the slag remains in the furnace.

It is desirable that the plug create an effective seal with the surface of the tap hole in order to minimize the leakage of slag past the plug. Also, it is desirable to install the plug deeply into the tap hole in order to minimize the amount of slag which can enter the tap hole. A plug must overcome certain formidable obstacles in order to achieve those goals.

SUMMARY OF THE INVENTION

The present invention, according to one aspect, is directed to a steel making assembly comprising a metal, refractory lined vessel having a side wall with a taphole therein and a metal plug within the taphole. The metal plug comprises a frustoconical body having a side conical wall, a closed small end and an open large end thereof defining an essentially empty interior space. The side conical wall of the frustoconical body of the plug includes at least one diagonal compression slit. The at least one diagonal compression slit extends from the open large end of the frustoconical body and extends toward the closed small end of the frustoconical body. The conical wall has a center axis, with the at least one diagonal compression slit being non-parallel to the center axis.

Another aspect of the present invention is to provide a plug configured for insertion into a taphole of a metal, refractory lined vessel during steel making. The plug comprises a metal frustoconical body having a side conical wall, a closed small end and an open large end thereof defining an essentially empty interior space. The side conical wall of the frustoconical body of the plug includes at least three diagonal compression slits. Each of the at least three diagonal compression slits extends from the open large end of the frustoconical body and extends toward the closed small end of the frustoconical body. The conical wall has a center axis, with each of the at least three diagonal compression slits being non-parallel to the center axis. Each of the at least three diagonal compression slits are curved.

Yet another aspect of the present invention is to provide a method of making steel comprising heating ore within a metal, refractory lined vessel to create molten steel and slag, with the metal, refractory lined vessel having a taphole. The method also includes providing a plug, with the plug comprising a metal frustoconical body having a side conical wall, a closed small end and an open large end thereof defining an essentially empty interior space. The side conical wall of the frustoconical body of the plug includes at least one diagonal compression slit. The at least one diagonal compression slit extends from the open large end of the frustoconical body and extends toward the closed small end of the frustoconical body. The conical wall having a center axis, with the at least one diagonal compression slit being non-parallel to the center axis. The method also includes inserting a plug into the taphole to close the taphole, tiling the metal, refractory lined vessel such that the slag passes the taphole and the molten steel covers the taphole and the plug, melting the plug after at least most of the slag passes the taphole, and removing the molten steel from the metal, refractory lined vessel through the taphole.

BRIEF DESCRIPTION OF THE DRAWINGS

One or more embodiments of the present invention are illustrated by way of example and should not be construed as being limited to the specific embodiments depicted in the accompanying drawings, in which like reference numerals indicate similar elements.

FIG. 8 is a first side view of the hole plug according to the first embodiment of the present invention.

FIG. 9 is a second side view of the hole plug according to the first embodiment of the present invention.

FIG. 10 is a third side view of the hole plug according to the first embodiment of the present invention.

The specific devices and processes illustrated in the attached drawings and described in the following specification are simply exemplary embodiments of the inventive concepts. Hence, specific dimensions and other physical characteristics relating to the embodiments disclosed herein are not to be considered as limiting.

DETAILED DESCRIPTION

For purposes of description herein, it is to be understood that the invention may assume various alternative orientations, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
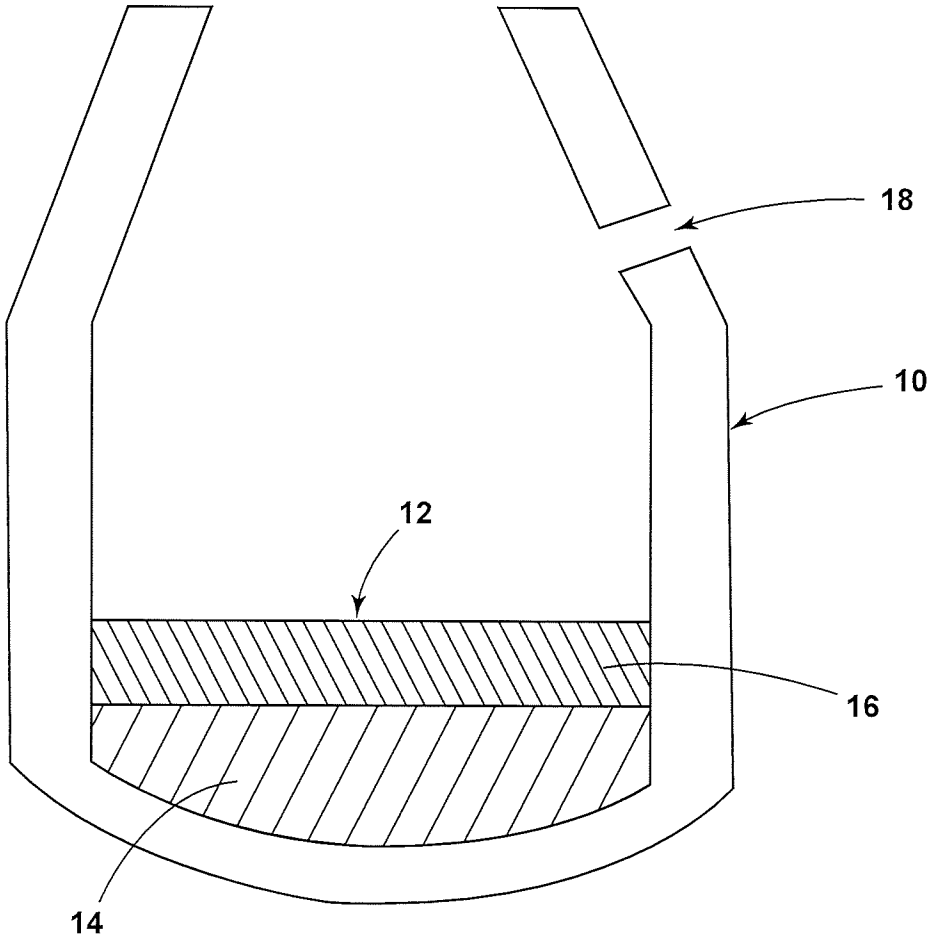
FIG. 1 is a schematic cross-sectional view of a metal, refractory lined vessel used in basic oxygen steelmaking during a first stage of steelmaking.

The reference number 10 (FIG. 1) generally designates schematic cross-sectional view of a metal, refractory lined vessel used in basic oxygen steelmaking during a first stage of steelmaking. As is well known to those skilled in the art, in basic oxygen steelmaking, carbon-rich molten pig iron is made into steel by blowing oxygen through molten pig iron, which lowers the carbon content of the alloy and changes the alloy into low-carbon steel. FIG. 1 illustrates a first stage after the steel is made wherein there is a multi-level substance 12 within the metal, refractory lined vessel 10 comprising molten steel 14 covered by slag 16. The slag 16 is a glass-like by-product left over after the steel 14 has been separated (i.e., smelted) from the raw ore.

Figure 2:
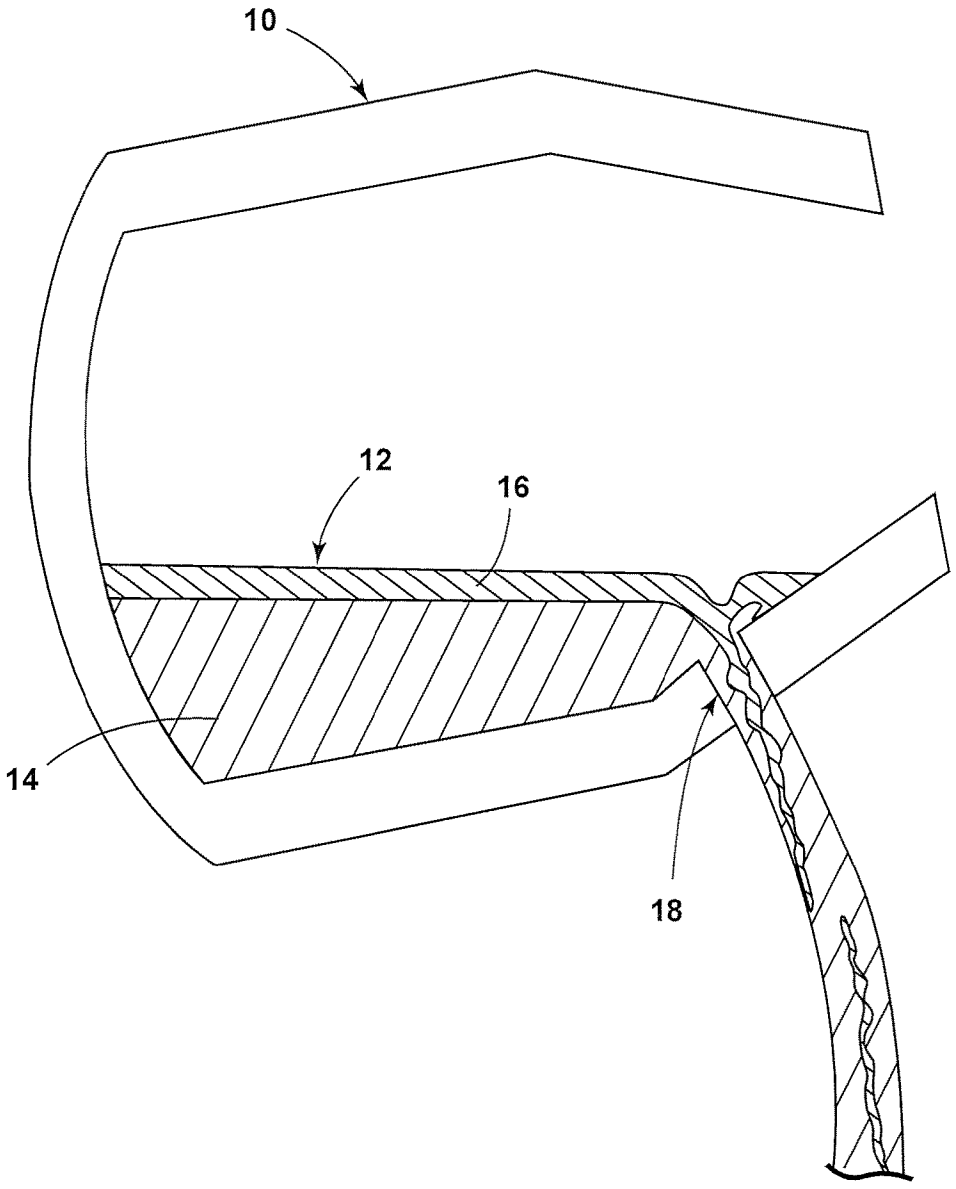
FIG. 2 is a schematic cross-sectional view of the metal, refractory lined vessel used in basic oxygen steelmaking during a second stage of steelmaking.

As shown in FIG. 1, the metal, refractory lined vessel 10 includes a taphole 18 for removing the molten steel 14 and the slag 16 from the metal, refractory lined vessel 10. FIG. 2 illustrates tipping of the metal, refractory lined vessel 10 to have the steel 14 exit through the taphole 18. In FIG. 2, since the slag 16 floats on the molten steel 14, the slag 16 will exit the taphole 18 first along with the steel 14. An aspect of the present invention is to provide for a system wherein the molten steel 14 is removed from the metal, refractory lined vessel 10 first and without any mixing of the slag 16 with the molten steel 14.

Figure 3:
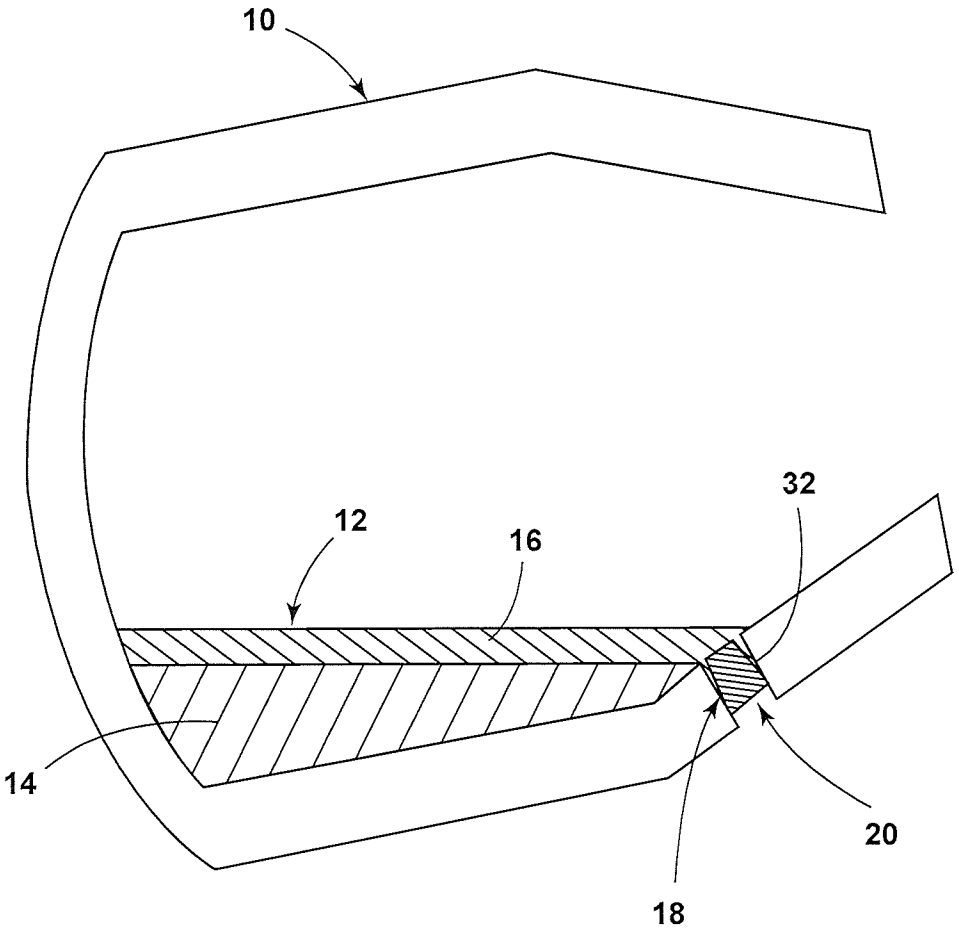
FIG. 3 is a schematic cross-sectional view of the metal, refractory lined vessel used in basic oxygen steelmaking during a third stage of steelmaking.
Figure 4:
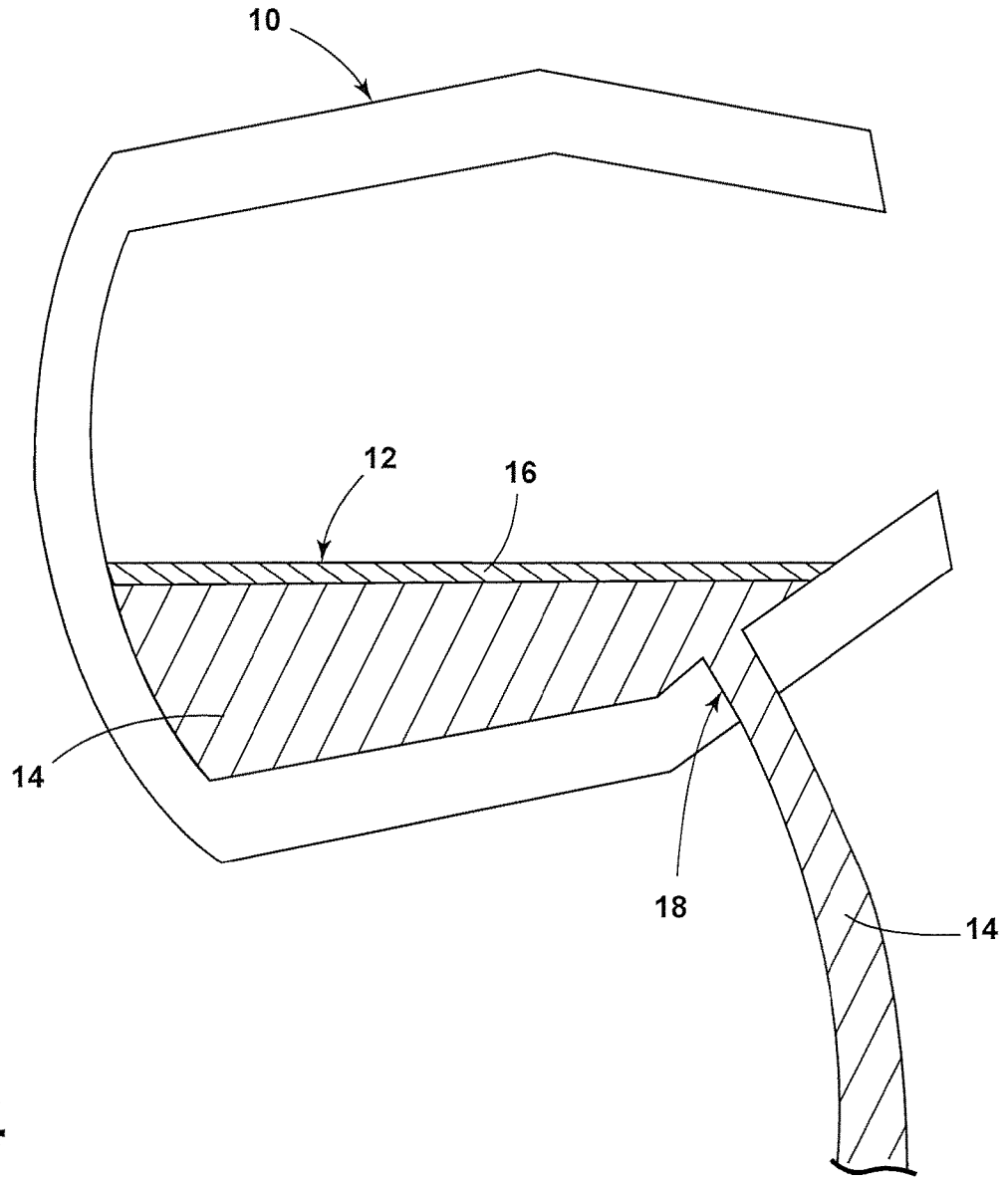
FIG. 4 is a schematic cross-sectional view of the metal, refractory lined vessel used in basic oxygen steelmaking during a second stage of steelmaking.
Figure 5:
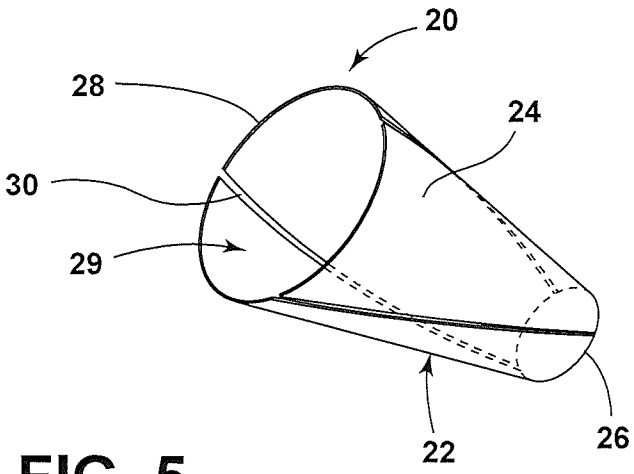
FIG. 5 is a perspective view of a hole plug according to a first embodiment of the present invention.
Figure 7:
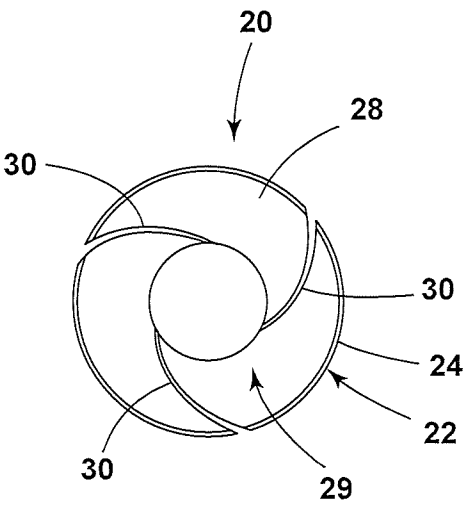
FIG. 7 is a bottom view of the hole plug according to the first embodiment of the present invention.
Figure 6:
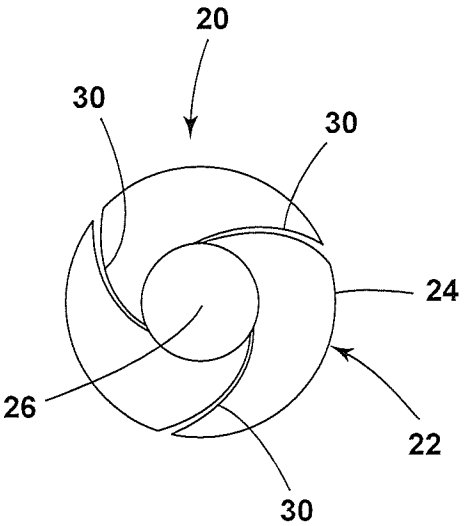
FIG. 6 is a top view of the hole plug according to the first embodiment of the present invention.
Figure 11:
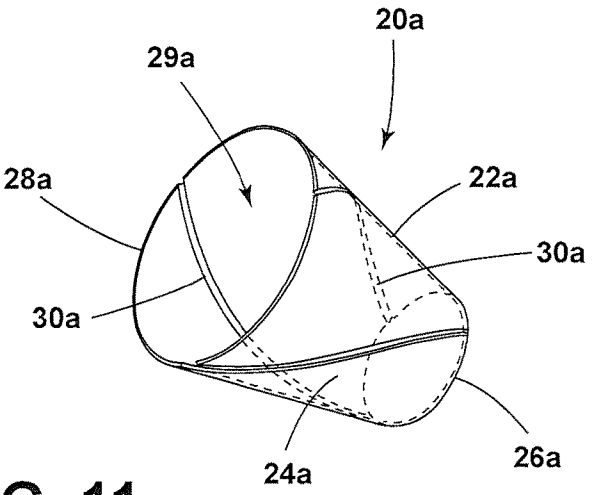
FIG. 11 is a perspective view of a hole plug according to a second embodiment of the present invention.
Figure 13:
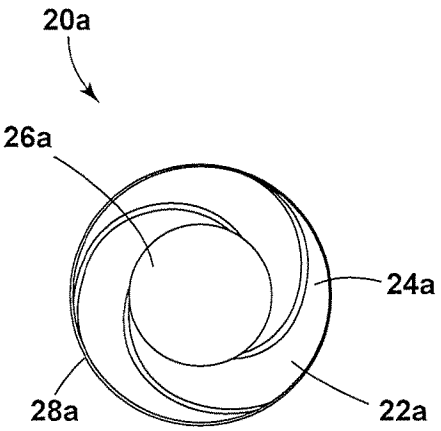
FIG. 13 is a bottom view of the hole plug according to the second embodiment of the present invention.
Figure 12:
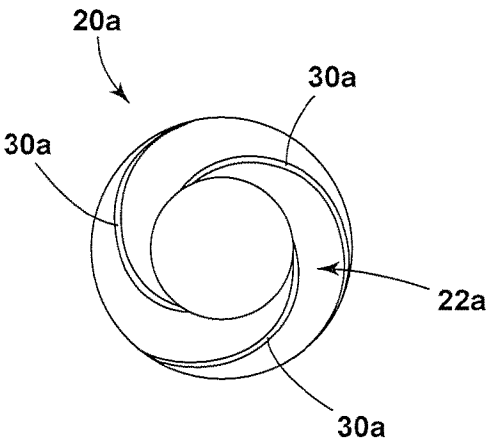
FIG. 12 is a top view of the hole plug according to the second embodiment of the present invention.
Figure 15:
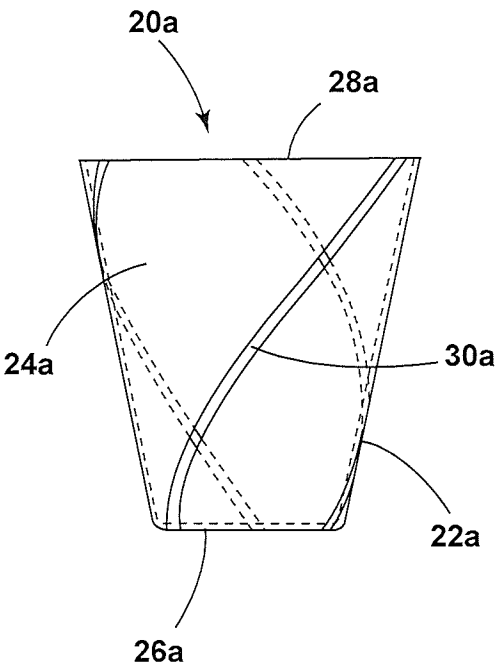
FIG. 15 is a second side view of the hole plug according to the second embodiment of the present invention.
Figure 14:
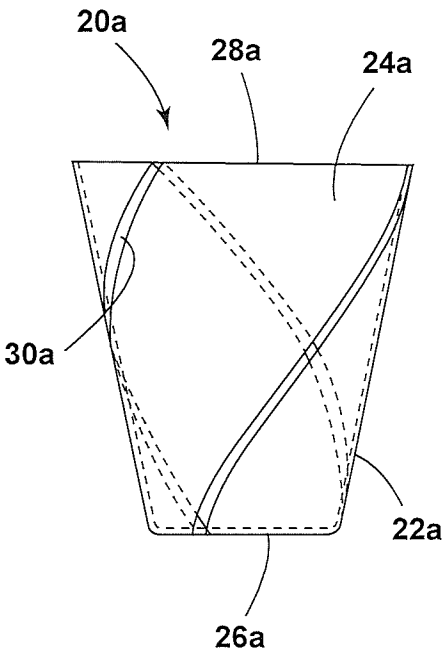
FIG. 14 is a first side view of the hole plug according to the second embodiment of the present invention.

As shown in FIG. 3, a plug 20 is inserted into the taphole 18 to prevent the slag 16 and the molten steel 14 from exiting the taphole 18 as the metal, refractory lined vessel 10 is tipped or rotated. Once at least most of the slag 16 passes the taphole 18 during further tilting or rotating of the metal, refractory lined vessel 10 as shown in FIG. 4, the plug 20 melts because of the higher temperature and greater specific gravity of the molten steel, thereby opening the taphole 18 to allow only the molten steel 14 with it's higher density (i.e., specific gravity) to escape through the taphole 18. Therefore, the molten steel 14 can be removed from the metal, refractory lined vessel 10 while the slag 16 remains therein. Typically, the molten steel 14 is delivered to a holding vessel (e.g., a ladle) to continue the steelmaking process which will ultimately form the steel 14 into various finished shapes.

Many prior art plugs have been used in the prior art to plug the taphole 18. Examples are disclosed in U.S. Pat. No. 4,995,594 entitled SLAG STOPPING PLUG FOR TAP HOLES OF METAL FURNACES CONTAINING MOLTEN MATERIAL and U.S. Pat. No. 6,602,069 entitled PLUG MEMBERS FOR STEEL FURNACES, the entire contents of both of which are incorporated herein by reference. The prior art plugs have included rolled burlap, insulated refractory blankets, preformed refractory shapes, soft refractory shapes, as well as various metallic devices. Prior art plugs also include truncated cones open on the larger end. The plug 20 as described herein is an improved plug compared to the prior art plugs.

FIGS. 5-10 illustrate a first embodiment of the plug 20 according to an embodiment of the present invention. The plug 20 includes a frustoconical body 22 having a side conical wall 24, a closed small end 26 and an open large end 28. The plug 20 has an essentially empty interior space 29. During use, the closed small end 26 of the plug 20 is inserted first into the taphole 18 such that the closed small end 26 encloses the metal, refractory lined vessel 10. In order to assist in proper and secure fit of the plug 20 within the taphole 18, the side conical wall 24 of the frustoconical body 22 of the plug 20 includes a plurality of diagonal compression slits 30. Each of the diagonal compression slits 30 extends from the open large end 28 of the frustoconical body 22 and ends short of the closed small end 26 of the frustoconical body 22. The diagonal compression slits 30 are not parallel to an axis of the diagonal compression slits 30, but are angled relative thereto. It is contemplated that the diagonal compression slits 30 would be curved or helical as shown in FIGS. 5-10 or could be straight. Furthermore, while three (3) diagonal compression slits 30 are shown in FIGS. 5-10, it is contemplated that any number of diagonal compression slits 30 could be employed including only one.

During use, the plug 20 is inserted into the taphole 18 of the metal, refractory lined vessel 10. While the plug 20 is being forced into the taphole 18 with the closed small end 26 entering the taphole 18 first, the side conical wall 24 will eventually encounter a side surface 32 (see FIG. 3) of the taphole 18. At that point, the edges 34 (see FIG. 10) of the diagonal compression slits 30 in the side conical wall 24 of the frustoconical body 22 of the plug 20 will move toward each other and encounter each other and/or the plug 20 collapses upon itself to provide for a better fit of the plug 20 within the taphole 18. The diagonal compression slits 30 conform to the constantly changing shape of the taphole 18 into which the plug 20 is inserted. It is contemplated that the edges 34 can be further away from each other at the open large end 28 of the frustoconical body 22 than near the closed small end 26 to help with the fit. It is contemplated that the diagonal compression slits 30 can extend the entire length of the side conical wall 24 from the closed small end 26 to the open large end 28 or can stop short of the closed small end 26.

With use of the plug 20 as disclosed herein, the plug 20 significantly reduces the slag 16 from laying on top of the molten steel 14 within the holding vessel (e.g., a ladle) and after the molten steel 14 passes through the taphole 18 as described above. Furthermore, with use of the plug 20, the flow of the molten steel 14 through the taphole 18 can be better controlled by virtue of lowering the metal refractory lined vessel tapping angle thus enhancing the stream of molten steel 14 through the taphole 18 into a more laminar flow, thus reducing re-oxidation of the steel 14 and potentially improving the amount of steel 14 to fit within the holding vessel (e.g., a ladle). Furthermore, because of the diagonal compression slits 30, the plug 20 can be driven more deeply into the taphole 18 and closer to the hot face as compared to the prior art plugs, thereby reducing a length of taphole blockages or undesired solidification by steel 14 or slag 16, which could significantly reduce time spent burning open tapholes 18 which can cause costly delays in downstream processes.

The reference numeral **20*a* (FIGS. 11-15) generally designates another embodiment of the present invention, having a second embodiment for the plug. Since plug 20*a* is similar to the previously described plug 20, similar parts appearing in FIGS. 5-10 and FIGS. 11-15, respectively, are represented by the same, corresponding reference number, except for the suffix "a" in the numerals of the latter. The plug 20*a* is substantially similar to the first embodiment of the plug 20, but with different dimensions. Therefore, the plug 20*a* includes frustoconical body 22*a*, a side conical wall 24*a*, a closed small end 26*a*, an open large end 28*a*, an essentially empty interior space 29*a*, and a plurality of diagonal compression slits 30*a*. The second embodiment of the plug 20*a*** is used in the metal, refractory lined vessel 10 in the same manner as the first embodiment of the plug 20.

The illustrated plugs 20, 20*a* can have any appropriate dimensions in order to fully close the taphole 18 and can be made of any appropriate material to withstand the heat involved in the process of making steel. As to dimensions, an example is to have an open large end 28 that has a 5 inch diameter and a closed small end 26 that has a 3 inch diameter. In this example, the diagonal compression slits 30 can end within one inch of the closed small end 26. Nevertheless, any dimension to fit the taphole 18 can be used. As to material, any material can be used (e.g., mild steel).

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A steel making assembly comprising: a metal, refractory lined vessel having a side wall with a taphole therein; and a metal plug within the taphole; wherein the metal plug comprises a frustoconical body having a side conical wall, a closed small proximal end and an open large distal end thereof defining an essentially empty interior space, the side conical wall of the frustoconical body of the metal plug including at least two diagonal compression slits, the at least two diagonal compression slits extending from the open large distal end of the frustoconical body and extending toward the closed small proximal end of the frustoconical body, the side conical wall having a center axis, with the at least two diagonal compression slits being non-parallel to the center axis so as to contract when received in the taphole.

2. The steel making assembly of claim 1, wherein: the at least two diagonal compression slits comprise at least three diagonal compression slits.

3. The steel making assembly of claim 2, wherein:

each of the at least three diagonal compression slits are curved.

4. The steel making assembly of claim 1, wherein: the at least two diagonal compression slits are curved.

5. The steel making assembly of claim 1, wherein: the at least two diagonal compression slits are spaced from the closed small proximal end.

6. A plug configured for insertion into a taphole of a metal, refractory lined vessel during steel making, the plug comprising: a metal frustoconical body having a side conical wall, a closed small proximal end and an open large distal end thereof defining an essentially empty interior space; the side conical wall of the metal frustoconical body of the plug including at least three diagonal compression slits, each of the at least three diagonal compression slits extending from the open large distal end of the metal frustoconical body and extending toward the closed small proximal end of the metal frustoconical body; and the side conical wall having a center axis, with each of the at least three diagonal compression slits being non-parallel to the center axis so as to contract when received in the taphole; wherein each of the at least three diagonal compression slits are curved.

7. The plug of claim 6, wherein: at least one of the at least three diagonal compression slits is spaced from the closed small proximal end.

8. A method of making steel comprising:

heating ore within a metal, refractory lined vessel to create molten steel and slag, the metal, refractory lined vessel having a taphole;

providing the plug according to claim 6;

inserting the plug into the taphole to close the taphole;

tiling the metal, refractory lined vessel such that the slag passes the taphole and the molten steel covers the taphole and the plug;

melting the plug after at least most of the slag passes the taphole; and removing the molten steel from the metal, refractory lined vessel through the taphole.

9. The method of claim 8, wherein: at least one of the at least three diagonal compression slits is spaced from the closed small proximal end.

* * * * *